United States Patent [19]

Schick

[11] 4,382,654

[45] May 10, 1983

[54] RESILIENT CONTACT SUPPORT FOR LAMP SOCKET

[75] Inventor: Henry Schick, Commack, N.Y.

[73] Assignee: Gilbert Manufacturing Co., Inc., Long Island City, N.Y.

[21] Appl. No.: 224,191

[22] Filed: Jan. 12, 1981

[51] Int. Cl.[3] ..... H01R 17/04

[52] U.S. Cl. ..... 339/176 L; 339/99 L; 339/177 L

[58] Field of Search ..... 339/99 L, 97 L, 176 L, 339/177 L, 178, 180, 182 L, 184 L, 185 RL, 189 L

[56] References Cited

U.S. PATENT DOCUMENTS

| | | | |
|---|---|---|---|
| 986,743 | 3/1911 | Murray | 339/180 |
| 2,965,875 | 12/1960 | Danesi | 339/180 |
| 3,372,362 | 3/1968 | Schick | 339/99 L |
| 3,504,329 | 3/1970 | Peterson et al. | 339/73 |
| 3,597,725 | 8/1971 | Beck et al. | 339/97 L |
| 4,246,632 | 1/1981 | Hancox | 339/176 L |

FOREIGN PATENT DOCUMENTS

| | | | |
|---|---|---|---|
| 109548 | 1/1944 | Sweden | 339/180 |
| 592965 | 2/1960 | United Kingdom | 339/176 L |
| 1126925 | 9/1968 | United Kingdom | 339/97 L |

*Primary Examiner*—John McQuade
*Attorney, Agent, or Firm*—Darby & Darby

[57] ABSTRACT

A lamp socket is provided with a body member or shell having an opening in its top and first and second electrical contacts in the shell to make electrical contact with a light bulb inserted into the shell. A tapered, resilient support arm projects inwards from a wall of the shell to engage the bottom face of an inwardly projecting tab portion of one electrical contact, which engages the base of the light bulb. This resilient arm prevents permanent deformation of the tab upon insertion of a light bulb to a greater than average depth into the socket and returns the tab to its initial position after the light bulb is removed. The other contact engages the light bulb ferrule.

4 Claims, 5 Drawing Figures

FIG. 1
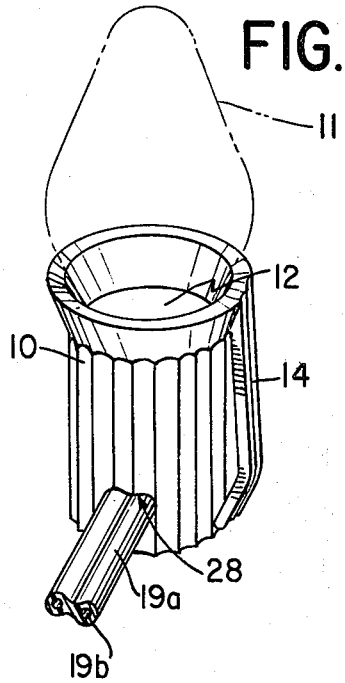
FIG. 2
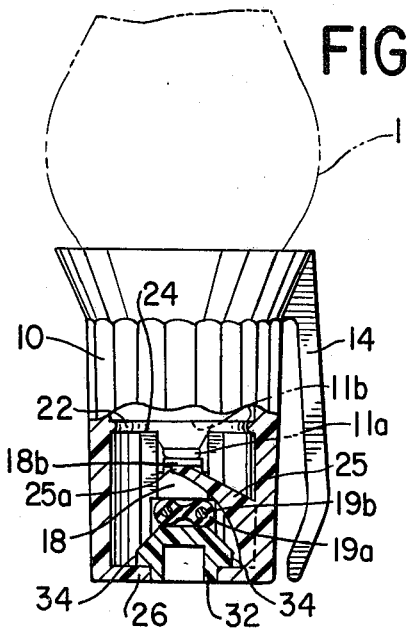
FIG. 5
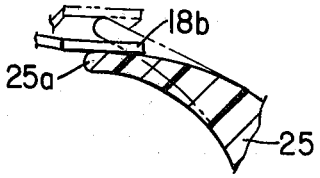
FIG. 3
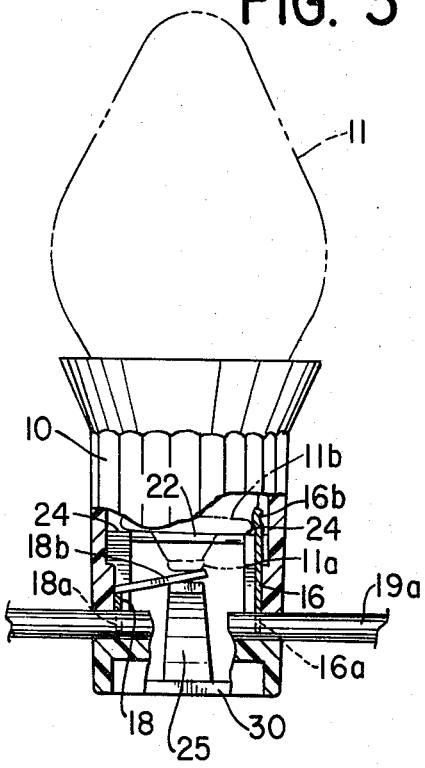
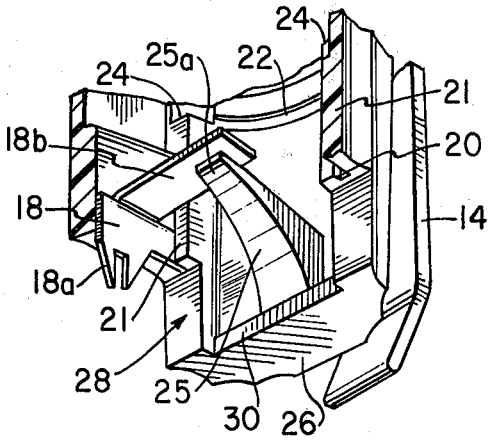
FIG. 4

RESILIENT CONTACT SUPPORT FOR LAMP SOCKET

BACKGROUND OF THE INVENTION

The present invention relates to lamp sockets, and more particularly to lamp sockets which can be readily connected to current carrying wires to be placed in a set, for example, for use in light strings for tree or outdoor lights, and which have electrical contact members in the socket shell, to engage complementary electrical contact portions of the base of a light bulb within the socket.

In the past, sockets for receiving light bulbs for tree lighting sets have generally included a relatively cylindrical shell having an open end for accommodating the base of a light bulb which is threadably engaged or engaged by a force fit with the socket shell at its inner face. The bottom of the shell is generally provided with an opening through which a pair of insulated current carrying wires passes. A pair of electrical contact members, each having a barb or prong at the lower end, is located on the inside of the shell and a cover member for the base is engaged with the shell base. The cover member is generally designed to force the wire into the shell so that the barb or prong of each electrical contact member engages one of the current carrying wires. A socket which incorporates these features is disclosed in U.S. Pat. No. 3,372,362 assigned to the assignee of the subject application.

In such a socket, one of the two electrical contact members usually has a tab portion which projects across the interior of the socket and is engaged by the bottom contact of the lamp base as the lamp is inserted into the shell. A problem sometimes arises in that with repeated insertions and removals of the lamp from the socket, particularly where the lamp socket is oversize in length, the projecting portion of the contact becomes permanently downwardly deformed and makes poor or no contact with the bottom contact of the lamp base.

In the past, efforts have been made to limit the downward travel of a bulb within the socket to a narrow range to prevent the base of the bulb from deforming the projecting tab portion of the one electrical contact member. The efforts to solve the problem have included providing stop pieces on the inner wall of the shell to prevent insertion of the light bulb base to too great a depth and molding internal threads onto the inner wall of the socket shell for receiving the external threads of a light bulb base. The internal threads have a termination point so disposed as to prevent the external threads of the light bulb base from being threaded too far into the shell.

Neither of these alternatives has been able to accommodate for the range of depths to which the base of a light bulb can extend due to manufacturing tolerances in the production of the bulbs. At present each bulb may extent to a depth slightly greater or lesser than the average. In addition, a person may use excessive force in threading a bulb into the socket. If the bulb extends too far, the projecting portion of the contact will become deformed after repeated insertion.

OBJECTS OF THE INVENTION

An object of the present invention is to provide a lamp socket with a radially projecting, resiliently supported electrical contact tab.

Another object is to provide in a lamp socket a resilient support arm for the radially projecting electrical contact tab.

Still a further object of the invention is to provide a lamp socket having a resilient support arm which urges a radially projecting electrical contact tab into engagement with the bottom terminal of a light bulb base.

BRIEF DESCRIPTION OF THE INVENTION

In accordance with the present invention a one-piece molded lamp socket is provided with a body member or shell having an opening in its top and first and second electrical contacts along opposite sides of the shell and at opposite sides of a diameter of the shell. Each contact has a prong or barb projecting from its bottom to engage a current carrying wire upon the wire being upwardly urged by a cover, into the socket. A resilient cantilever support arm is formed on a wall of the shell to engage the bottom face of one electrical contact, which has a bent-over tab portion radially projecting across the interior of the socket. The support arm urges the tab upwardly so that the contact tab makes good electrical contact with the bottom terminal of the light bulb base. The resilient support arm also permits a light bulb having a base deeper than average, to be threaded into the socket and electrically engage the tab. When the bulb is removed, the resilient support arm urges the tab to return to the radially projecting position. Because of the relatively upward urging of the tab by the resilient support arm, the tab is not permanently deformed or broken off when the light bulb is removed.

BRIEF DESCRIPTION OF THE DRAWINGS

Other objects and advantages of the present invention will become more apparent upon reference to the following specification and annexed drawings in which:

FIG. 1 is a perspective view of the lamp socket assembly of the present invention;

FIG. 2 is an elevational view broken away and in partial cross-section of the socket with a light bulb inserted;

FIG. 3 is another elevational view taken in partial cross section of the socket of FIG. 2 turned by 90°, with a light bulb of less than average depth in the socket;

FIG. 4 is a fragmentary perspective view of the bottom of the socket; and

FIG. 5 is a fragmentary, elevational view of the support arm engaging the projecting tab.

DESCRIPTION OF THE PREFERRED EMBODIMENT

Referring to FIGS. 1–5, the lamp socket includes a body member, or shell, 10 having an opening 12 in its top portion to provide for insertion of the base of a light bulb 11, which is shown in phantom. The shell can also have an integrally molded clip 14 which permits the socket to be hung on an object, such as a tree limb. The entire socket, including the resilient support arm, is preferably molded in one piece from a suitable material, preferably a thermoplastic such as polypropylene, ABS, etc.

As shown in FIGS. 2–5, the shell 10 is provided with a first electrical contact 16 and a second electrical contact 18, preferably located at opposite sides of a diameter of the shell. A pair of walls 21 are formed on each side of the shell to define channels 20. The contacts 16, 18 are each disposed within a respective one of the channels 20.

Referring now to FIGS. 2 and 3, each electrical contact 16,18 has a respective prong-like bottom portion 16*a*, 18*a* at its bottom end for piercing the insulation of a two conductor current carrying wire 19. Wire 19 includes an insulation member 19*a* surrounding each of the current carrying wires 19*b*.

Each electrical contact also includes a respective portion 16*b*,18*b* for contacting the light bulb base. The contact portion of contact 16 includes at its upper end an inwardly projecting bead 16*b*. The contact portion of contact 18 includes at the upper end, a bent-over relatively radially projecting tab 18*b*. The bead 16*b* is generally disposed closer to the top of the shell than tab 18*b* in order to provide for appropriate electrical contact with the corresponding ferrule 11*b* and base terminal 11*a*.

The contacts 16 and 18 are force fit into the channels 20. During the assembly of the socket, these contacts can be inserted to a predetermined height so that the relative height of bead 16*b* and tab 18*b* above the base of the socket, and, accordingly the relative depth from opening 12 of the socket can be preselected.

The shell 10 can include molded helical grooves or internal threads 22 in its inner face to receive the external threads of the light bulb inserted into the socket or, alternatively, be of the push-in type as described in U.S. Pat. No. 3,504,329, which is also assigned to the assignee of the subject application. Molded, inwardly projecting rigid stop pieces 24 are provided relatively opposite each other on inside faces of shell 10 along the walls 21 which form contact channels 20. These stop pieces engage the bottom-most portion of the threaded ferrule 11*b* to prevent excessive downward insertion of the light bulb 11.

In the preferred embodiment, the tab 18*b* of contact 18 is bent over at an angle which is slightly acute to a cross-sectional plane of the shell. As shown most clearly in FIG. 3, this provides for electrical contact between base terminal 11*a* of light bulb 11 and tab 18*b*.

As shown in FIGS. 2 and 4, the opening in base 26 includes an indent 30 which is provided for the purpose of positioning and holding a base cover 32. Cover 32 includes arms 34 provided to engage the upper surface of base 26 adjacent the indent 30.

As seen in FIGS. 3 and 4, a cantilever arm 25 is formed on the interior of the shell wall, at a position between the opposing stop pieces 24, and projecting inwardly of the socket. Arm 25 has a relatively wide base at the shell wall and tapers out to a narrow arm 25*a*, the end of which is a support for contact 18*b*. In the preferred embodiment, the arm 25*a* projects relatively radially of and upwardly from the inside wall of shell 10. Since this tapered arm is molded, with the shell, from a thermoplastic, there is inherent vertical resiliency at the end of the tapered arm 25*a*, which is under the contact 18*b*.

The cantilever arm 25 provides resilient support for tab 18*b*, allowing for engagement between tab 18*b* and light bulb base contact 11*a*, when the light bulb bases are of differing lengths and seen by comparing the position of tab 18*b* and tapered arm 25*a* in FIGS. 2, 3 and 5. The tapered arm 25*a* is preferably disposed relatively perpendicular to tab 18*b*.

Arm 25*a* prevents contact 18*b* from becoming deformed upon insertion of a long light bulb base. Such deformation would result in no electrical contact when a short base is subsequently inserted into the socket. In its relaxed position (i.e. no bulb screwed in) the resilient, tapered arm 25*a* supports the tab 18*b* in a slightly raised position so that bulbs having relatively short bases can still be contacted by the tab 18*b* when inserted into the socket.

Because of its material and shape, tapered arm 25*a* maintains upward pressure on tab 18*b* after a bulb is inserted into the socket and the arm is bent. When the bulb is removed from the socket, arm 25*a* returns to its original, relaxed position and returns tab 18*b* to its original, relaxed position.

The resiliency of tapered arm 25*a* enables socket 10 to be used with light bulbs of different relative depths. If the base 11*a* of the bulb is relatively long, both tab 18*b* and arm 25*a* will flex downwardly in order to receive the light bulb and maintain electrical contact. If the depth of the bulb is relatively less than average, the tab 18*b* and arm 25*a* are initially disposed at a position slightly above the average depth and therefore tab 18*b* maintains electrical contact with the light bulb. With respect to a light bulb of average depth, only slight downward flexion of the respective parts occurs.

The shell 10 is formed with a base 26 including an opening 28 running therethrough and aligned with the contact members 16 and 18. The opening 28 extends upwardly through the side walls of the shell 10 to allow current carrying wires 19 to be passed therethrough.

In assembling the socket to the current carrying wire 19 the sockets are placed into a machine which aligns them. Contacts 16 and 18 are inserted by the machine, from the top of the shell, into channels 20, and one contact is bent over to form tab 18*b*. The current carrying wire 19 is then inserted into opening 28 in the base and cover member 32 is inserted into the opening. During the assembly of the sockets, the integrally formed clip 14 can serve as a point of orientation so that the components are inserted in a uniform arrangement in each individual socket.

When cover member 32 is inserted into the socket it forces wire 19 against prongs 16*a* and 18*a*. The prongs penetrate through the insulation 19*a* and engage the current carrying wires 19*b*.

While a preferred embodiment of the invention has been described above, it will be understood that this is illustrative only and that the invention is limited solely by the appended claims.

What is claimed is:

1. A light bulb socket assembly comprising:

a body member having an opening in its top for insertion of a light bulb and an opening at its bottom to accommodate the passage through the body member of a pair of current carrying wires, a pair of electrical contacts held within said body member for contact between the current carrying wires and the light bulb, each said contact having a first portion for making contact with the current carrying portion of one of said pair of current carrying wires and a second portion for making contact with a current carrying portion of a light bulb, the second portion of at least one of said electrical contacts including an electrical tab projecting across the interior of the body member for engaging a base terminal of the light bulb; and relatively resilient cantilevered support means projecting radially inward from a wall of said socket and disposed at a predetermined position below said tab for limiting downward displacement of said tab.

2. A socket assembly as in claim 1 wherein the support means is disposed relatively perpendicular to the tab.

3. A socket assembly as described in claim 1 wherein the projecting tab is disposed at a relatively acute angle to a cross-sectional plane of the body member, said cross-sectional plane being substantially perpendicular to a direction of said insertion of said light bulb.

4. A light bulb socket assembly as described in claim 1 including means on the walls of the body member for limiting the depth to which a base of the light bulb can be inserted into the body member.

* * * * *